United States Patent [19]

Wainwright

[11] 4,301,782

[45] Nov. 24, 1981

[54] IGNITION SYSTEM

[76] Inventor: Basil E. Wainwright, 80 Greenaleigh Rd., Yardley Wood, Birmingham, England

[21] Appl. No.: 48,253

[22] Filed: Jun. 13, 1979

Related U.S. Application Data

[63] Continuation-in-part of Ser. No. 944,142, Sep. 20, 1978, abandoned.

[30] Foreign Application Priority Data

Sep. 21, 1977 [GB] United Kingdom ..... 39393/77
Jun. 4, 1979 [GB] United Kingdom ..... 19431/79

[51] Int. Cl.[3] ..... F02P 15/00

[52] U.S. Cl. ..... 123/620; 123/596; 123/627; 123/628; 315/176; 315/209 CD

[58] Field of Search ..... 123/596, 598, 620, 627, 123/628, 640; 315/209 CD, 176

[56] References Cited

U.S. PATENT DOCUMENTS

| | | | |
|---|---|---|---|
| 2,503,054 | 4/1950 | Laird | 315/209 CD |
| 2,536,143 | 1/1951 | Short et al. | 315/209 CD |
| 3,383,553 | 5/1968 | Parish et al. | 315/209 CD |
| 3,788,293 | 1/1974 | Anderson | 123/596 |
| 3,837,326 | 9/1974 | Kamiji | 123/596 |
| 3,906,919 | 9/1975 | Asik et al. | 123/598 |
| 3,921,606 | 11/1975 | Habert | 123/596 |
| 4,033,316 | 7/1977 | Birchenough | 123/598 |
| 4,136,301 | 1/1979 | Shimojo et al. | 315/209 T |

*Primary Examiner*—Charles J. Myhre
*Assistant Examiner*—Andrew M. Dolinar
*Attorney, Agent, or Firm*—Laubscher, Philpitt & Laubscher

[57] ABSTRACT

An apparatus for producing spark ignition of an internal combustion engine is disclosed including a spark generator which supplies spark generating pulses to spark plugs of the engine. The spark produced by each pulse is sustained after the pulse has died away by means of a generator which applies to the spark plugs a voltage capable of sustaining but not initiating sparks across the spark plugs. The generator is per se capable of developing a continuous output so as to maximize the spark energy and to allow the duration of the spark to be selected as desired. The output of the generator may be applied to the spark plugs continuously in which case the effect of increased impedance to the spark produced on combustion is used to terminate the spark. Alternatively, the output of the generator can be switched to terminate the spark.

10 Claims, 5 Drawing Figures

IGNITION SYSTEM

CROSS REFERENCE TO RELATED APPLICATION

This application is a continuation in part of my patent application Ser. No. 944,142 filed Sept. 20th, 1978, abandoned.

FIELD OF THE INVENTION

The invention concerns improvements in and relating to apparatus for producing spark ignition of an internal combustion engine.

BACKGROUND TO THE INVENTION

It is well known that the electrical sparks fed to the spark plugs of an internal combustion engine are conventionally produced by means of an ignition coil having its high voltage secondary winding connected to the engine's spark plugs through a distributor, and having its low voltage primary winding connected to a low voltage source, typically a 12 volt battery or an alternator system driven by the engine. An engine driven switching device, typically a mechanical contact breaker, produces interruptions in the current flowing in the coil's primary winding and consequently high voltage pulses are produced in the coil's secondary winding, which are applied to the spark plugs.

Recently, a proposal has been made to increase the energy of the sparks applied to the spark plugs, by connecting a capacitor to the primary coil of the winding, charging the capacitor to a voltage much higher than the conventional 12 volt supply voltage from the engine's battery and alternator, and discharging the capacitor through the coil's primary winding each time a spark is required. With such a capacitive discharge system, the total spark energy for each firing of a cylinder of the engine, is increased substantially with respect to the conventional spark ignition apparatus, but the duration of the sparks produced by the system is much less than those produced by the conventional apparatus. Such shorter sparks can prove disadvantageous with certain engines, since the sparks may not produce a complete ignition of the fuel/air mixture.

It has been proposed in British Patent Specification No. 1,427,600 to Hitachi Ltd. to provide a combination of the aforementioned two types of ignition system, which results in a system in which the sparks are initiated by the relatively short high energy pulses from the capacitor discharge system, and the sparks are maintained after completion of the capacitor discharge by the lower energy longer duration pulses from the conventional system.

The Hitachi arrangement however suffers from the disadvantage that the system is essentially a pulsed system in which pulses are inductively coupled through ignition coils to the spark plugs, which limits the energy that can be supplied to sustain the spark, and also imposes a limit on the maximum duration of the spark. With this pulsed system, the current flowing in the arc established between the spark plug's electrodes necessarily gradually reduces towards zero towards the end of the period of the spark, which limits the total spark energy that can be injected by the pulsed system into the spark.

SUMMARY OF THE INVENTION

I have now found that a substantial improvement in fuel economy and a significant reduction in pollutant emission for an engine can be achieved if the sparks, after having been initiated, and are sustained by means of a separate generator capable per se of producing a continuous voltage for sustaining the spark.

The voltage from the generator can be applied to the spark plugs on a continuous basis, in which case, the voltage thereof is selected so that each spark is terminated automatically by virtue of the increased gas pressure in the engine resulting from the combustion of fuel/air mixture by the spark. I have found that the increasing gas pressure presents an increasing electrical impedance to the arc established between the electrodes of a spark plug, and so by appropriately selecting the voltage produced by the generator it is possible to have the spark terminate automatically when the gas pressure rises to a level indicative of satisfactory combustion of the fuel/air mixture.

Alternatively, the sparks can be terminated by disconnecting the output of the generator from the spark plugs or by switching off the generator.

The present invention has the advantage that because the generator is capable of producing a continuous voltage, the current flowing in the arc between the electrodes of the spark plug does not reduce to zero towards the end of the spark, and hence the spark energy can be increased substantially. Also, the duration of the spark can be selected as desired, by virtue of the fact that the generator can per se produce a continuous output and can be larger than with the prior art systems.

The invention has application to systems in which the sparks are initiated by the conventional system previously described, by means of a capacitor discharge system or other electronic systems, and provides with all such systems a substantial improvement in the efficiency of fuel burning with an attendant improvement in fuel economy and a reduction in pollutant emission.

The invention can be carried into effect by adding to an existing ignition system a generator capable of supplying a spark sustaining voltage to the spark plug(s), and in one form the invention provides an add-on unit including the generator and a voltage isolating means which allows the pulses from the existing ignition system and the spark sustaining voltage from the generator to be applied effectively independently to the spark plug(s).

Further features and advantages of the invention will become apparent from the following description of preferred embodiments thereof and the accompanying drawings.

DESCRIPTION OF PREFERRED EMBODIMENTS

Figure 1:
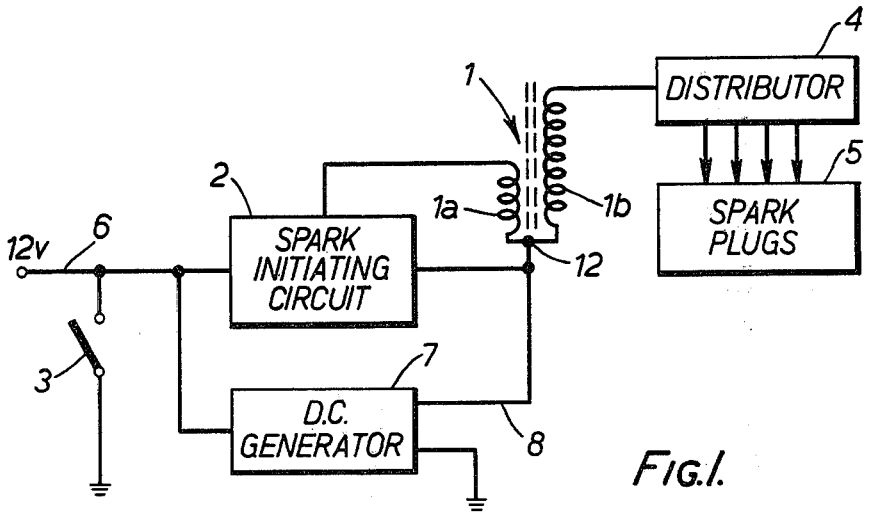
FIG. 1 is a schematic circuit diagram of a first embodiment of an ignition system according to the invention.

Referring to FIG. 1 there is shown a spark generating means which includes a conventional ignition coil 1, a spark initiating circuit 2 and a contact breaker 3. The ignition coil 1 includes a low tension primary winding 1*a* connected to the spark initiating circuit 2, and the circuit 2 is adapted to produce a rapid rate of change of current flow in the primary winding 1*a* in response to operation of the contact breaker 3. The coil also includes a secondary winding 1*b* and the rapid rate of change of the current in the primary 1*a* induces a high voltage pulse in the secondary 1*b*. This high voltage pulse is capable of producing spark ignition in an internal combustion engine and the pulse is applied through a distributor 4, which may be any of the well known types, to spark plugs 5 installed in cylinders of the engine (not shown).

This spark generating means is thus conventional in its operation. The contact breaker 3 may be of the conventional mechanical contact type or may be of the photoelectric or other contactless types more recently developed. Similarly the spark initiating circuit 2 may be the conventional arrangement which applies a nominally 12 volt supply on line 6 from the conventional battery/alternator arrangement of the engine (not shown), to the primary winding 1*a* and which uses the contact breaker 3 to interrupt the supply in order to produce a rapid rate of change of current in the primary. Alternatively, the spark initiating circuit 2 may be a transistorized circuit, or a capacitor discharge circuit as will be explained in more detail hereinafter with reference to FIG. 3.

Thus, in operation of the spark generating means, high voltage pulses are produced in the coil secondary winding 1*b* in response to the successive operations of the contact breaker 3, these pulses being appropriately supplied by the distributor 4 to successive ones of the spark plugs 5 so as to establish sparks in successive ones of the cylinder and thereby ignite fuel/air mixture in the cylinders.

In accordance with the invention, a generator is provided, which applies to the spark plugs a current capable of sustaining a spark across the spark plugs after the high voltage spark initiating pulse produced by the circuit 2 has died away to a level incapable of maintaining the spark. The generator in this example comprises a d.c. generator 7 adapted to produce a d.c. voltage for sustaining a spark initiated by the circuit 2. The d.c. generator 7 comprises a d.c. to d.c. converter arranged to generate a high voltage output of nominally 2000 volts from the low voltage 12 volt supply from the line 6. The generator 7 produces a rectified d.c. output current on line 8, which is fed through the secondary 1*b* of the coil to the distributor 4 and hence to the spark plugs 5. The output of the generator 7 is of a magnitude selected to sustain but not initiate a spark established across one of the spark plugs, and the generator 7 is per se capable of producing a continuous voltage of such a magnitude. I have found that once the spark has been initiated by the high voltage pulse from the spark initiating circuit 2, the spark can be sustained by a somewhat lower voltage, and the d.c. generator 7 is suitable for providing such a sustaining voltage. The fact that spark sustaining current is supplied by the separate generator 7 provides the advantage of allowing much greater spark currents to be established between the electrodes of the spark plugs 5 than has hitherto been possible, which provides for improved fuel burning and results in improved fuel economy and a reduction in pollutant emission.

In one form of the invention, the generator 7 develops a continuous output voltage and each spark is extinguished by the increased gas pressure in the engine's cylinder produced by the combustion initiated by the spark. The increased gas pressure presents an increased electrical impedance to the arc established between the spark plug electrodes, and the voltage level produced by the generator 7 can be appropriately selected so that the increased gas pressure will cause the spark automatically to extinguish when the gas pressure rises to a given level indicating that satisfactory combustion has occurred in the cylinder. Thus, when the given pressure level is reached in the cylinder, the voltage produced by the generator 7 is insufficient to maintain the spark, and the spark will terminate automatically.

In an alternative arrangement, the d.c. generator 7 is switched off and on again so as to terminate the spark.

Because the generator 7 is per se capable of producing a continuous high voltage output, the period that the generator 7 can be switched to supply the spark sustaining voltage to the sparks, can be selected independently of the characteristics of the circuit of the generator 7 and thus the duration of the output voltage can be selected for example to be from a few milliseconds to an effectively infinite duration. This arrangement allows the spark duration to be controlled independently of the characteristics of the circuit, and allows the current flowing through the arc established across the spark plug to be substantially constant during the entire period that the spark is sustained by the voltage from the generator 7. This is in contrast to prior systems wherein pulses are inductively coupled to the spark plug and towards the end of the spark duration, the current dies away to zero. Accordingly the system of the invention allows the spark duration to be extended and energy to be increased which improves engine combustion, as previously stated.

Figure 2:
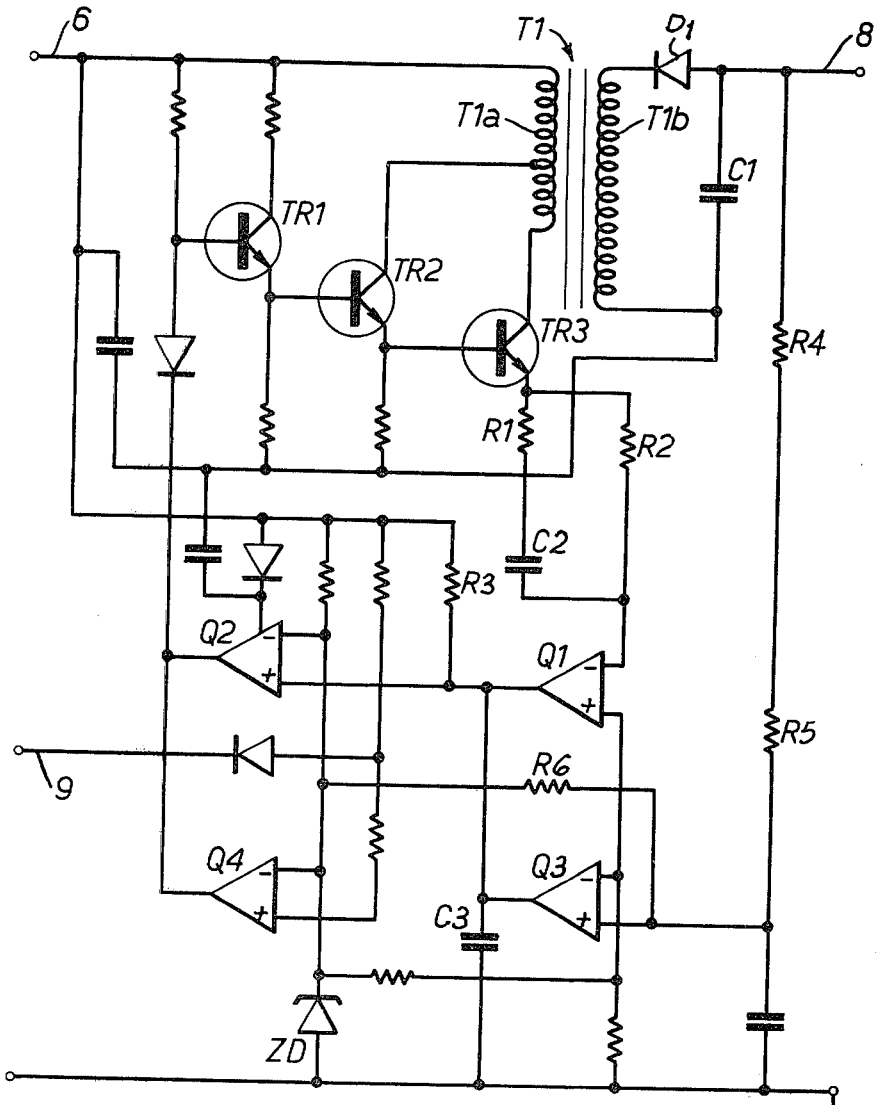
FIG. 2 is a circuit diagram of a d.c. to d.c. converter for use as the d.c. generator 7 of FIG. 1.

An exemplary form of the d.c. generator 7 will now be described with reference to FIG. 2. The generator 7 comprises a d.c. to d.c. converter including a step up transformer T1 having primary and secondary windings T1*a*, T1*b*. An oscillator powered from the low voltage supply 6 feeds an alternating signal into the primary winding T1*a* which induces a high voltage alternating current in the secondary winding T1*b*. The high voltage alternating current is rectified and smoothed by a diode D1 and a capacitor C1 to provide a d.c. output of typically 2000 volts on line 8.

The low voltage oscillator consists of a ganged chain of transistors TR1, TR2, TR3 which switch current through the primary winding T1*a* to a charging circuit comprising resistors R1, R2 and capacitor C2. The voltage level of the charging circuit is compared by a comparator Q1 with a predetermined reference voltage established by a zener diode ZD. The output of the comparator Q1 is fed to be compared in another comparator Q2 with another predetermined reference voltage established by the zener diode ZD, and the output of the comparator Q2 is fed to the base of transistor TR1, to control switching of the ganged transistor chain.

Thus, assuming an increasing current in the primary winding T1*a*, the voltage established across the charging circuit R1, R2, C1 builds up and when this level is sensed by the comparator Q1 is equal to the predetermined voltage applied to Q1 by the zener diode ZD, the output of Q1 goes low, which switches the output of comparator Q2 to a low state. The output of comparator Q2 thereby switches transistor TR1 such that transistor TR3 is switched off. The switching off of transistor TR3 collapses the magnetic field in the primary T1*a* which induces an alternating current in the secondary T1*b*, this current being rectified by the diode D1 to provide the output on line 8.

The transistor TR3 is switched on again by means of a capacitor C3 which is charged from the low voltage supply 6 through a resistor R3. When, as previously mentioned, the output of the comparator Q1 goes low to switch off the transistors TR3, the capacitor C3 can then be charged through the resistor R3 and after a time the voltage established across the capacitor C3 builds up to a level equal to the predetermined voltage applied by the zener ZD to the comparator Q2. At this time, the output of comparator Q2 changes state so as to switch transistor TR1 and thereby switch transistor TR3 on again, thus causing the oscillation cycle to repeat.

The circuit also includes a feedback circuit to control the voltage level on output line 8, the feedback circuit including a comparator Q3 which compares the output voltage on line 8, when dropped through resistors R4, R5, with a predetermined voltage from the zener ZD. If the output voltage on line 8 rises too high, the output of comparator Q3 goes high, overriding comparator Q1 and causing comparator Q2 to switch off the transistor TR3.

The circuit further includes an input arrangement which allows the duration of the output on line 8 to be controlled in response to an input signal. A further comparator Q4 is arranged to compare an input signal fed to an input terminal 9 with a predetermined voltage from the zener diode ZD. When the input signal voltage is less than the predetermined voltage, the output of the comparator holds the transistor TR1 switched off, overriding the output of comparator Q2. The input signal to terminal 9 may be typically derived from the contact breaker 3 so that the spark sustaining voltage on line 8 is switched off towards the end of each engine firing period.

From the foregoing, it will be seen that the generator 7 is per se capable of developing a continuous spark sustaining voltage which may be applied to the spark plugs on a continuous basis or may be switched on and off by means of the input 9, the switching period however being selectively variable as desired and the characteristics of the generator do not in themselves impose any limitation on the maximum duration of the sustaining voltage that may be selected.

Figure 3:
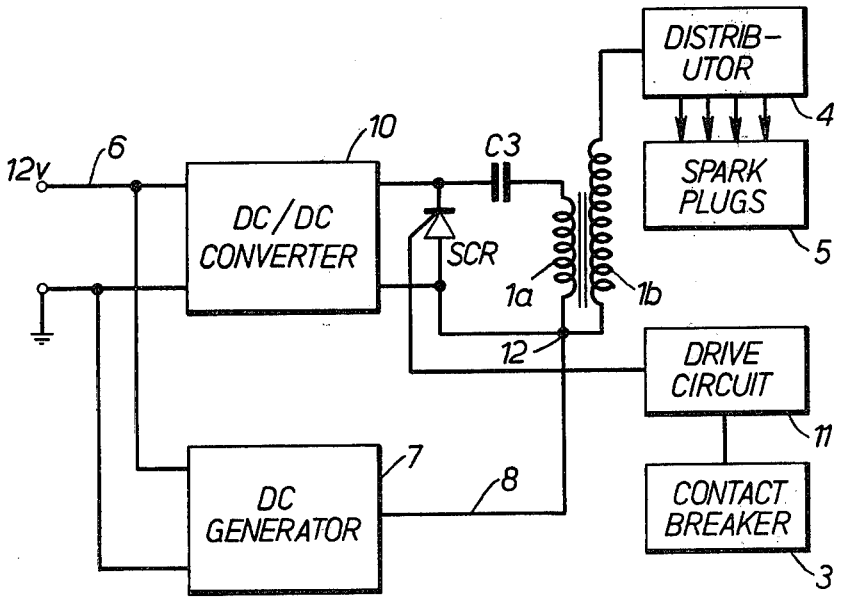
FIG. 3 is a more specific circuit diagram of a second embodiment of ignition system according to the invention wherein a capacitor discharge system is used to initiate the sparks.

As previously mentioned, the spark initiating circuit 2 can be of any suitable type. An example of the arrangement of FIG. 1 wherein the spark initiating circuit is of the capacitor discharge type will now be described with reference to FIG. 3 in which like parts to those of FIG. 1 are marked with the same reference numerals. In FIG. 3, the spark initiating circuit consists of a capacitor C3 which is charged by means of a d.c. to d.c. converter 10 to a relatively high voltage of typically 200 volts from the 12 volt supply line 6. The capacitor C3 is discharged through the primary winding 1*a* of the coil 1 in order to produce a rapid rate of charge of current therein and thereby induce a spark initiating pulse in the coil's secondary winding 1*b*. The discharge of the capacitor is effected by firing a thyristor SCR, the gate of which receives a firing pulse from a drive circuit 11 responsive to operation of the contact breaker 3.

As is known in the art, capacitive discharge systems produce pulses with a much faster risetime and greater peak voltages than a conventional system in which the 12 volt supply flows in the coil's primary winding and is switched off by a mechanical contact breaker. However, with capacitive discharge systems, the duration of the spark producing pulses are shorter than with the mentioned conventional system, and this relatively short duration can lead to incomplete burning of the fuel. However, with the embodiment of the invention shown in FIG. 3, the duration of the spark initiated by discharge of the capacitor C3 is sustained by means of the d.c. generator 7, after the capacitor discharge can no longer maintain the spark, resulting in improved fuel burning with an attendant improvement in fuel economy and a reduction in pollutant emission.

In the examples of the invention described with reference to FIGS. 1 and 3, the d.c. generator 7 is connected in series with the secondary winding 1*b* of the coil 1. The coil 1 is of the conventional type wherein the primary and secondary windings 1*a*, *b* are connected in series, this series connection being itself connected to earth in conventional ignition systems. Thus, with the above described examples of the invention, the spark initiating circuit must be so arranged that it does not provide a path to earth through the coil's primary winding 1*a*. Whilst this is quite possible to achieve, it may in certain circumstances prove disadvantageous from a commerical standpoint, because the present invention can be carried into effect by modification of conventional ignition systems already in production for particular models of engine, and it may not be desirable for the purposes of economics to modify an existing spark initiating circuit.

Figure 4:
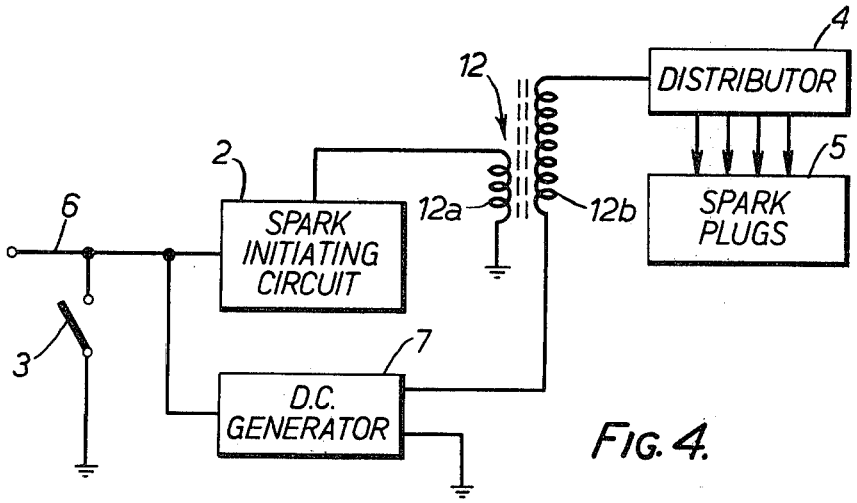
FIG. 4 illustrates another embodiment of the invention wherein a specially wound coil is used to connect the d.c. generator to the spark plugs.

FIG. 4 illustrates a circuit arrangement which allows the present invention to be readily carried into effect with an existing spark initiating circuit 2. In this arrangement, the conventional coil 1 of FIGS. 1 and 3 is replaced by a specially wound coil 12 which has primary and secondary windings 12*a*, *b* separately wound. The current produced by the spark initiating circuit 2 flow to earth through the primary winding 12*a*, and the current fed by the d.c. generator 7 to the spark plugs flows through the secondary winding 12*b* without being able to pass to the primary winding. Thus, the system of FIG. 4 can be installed on an existing engine fitted with a conventional or electronic ignition system, by replacing the conventional coil with the specially wound coil 12, and fitting the d.c. generator 7.

Figure 5:
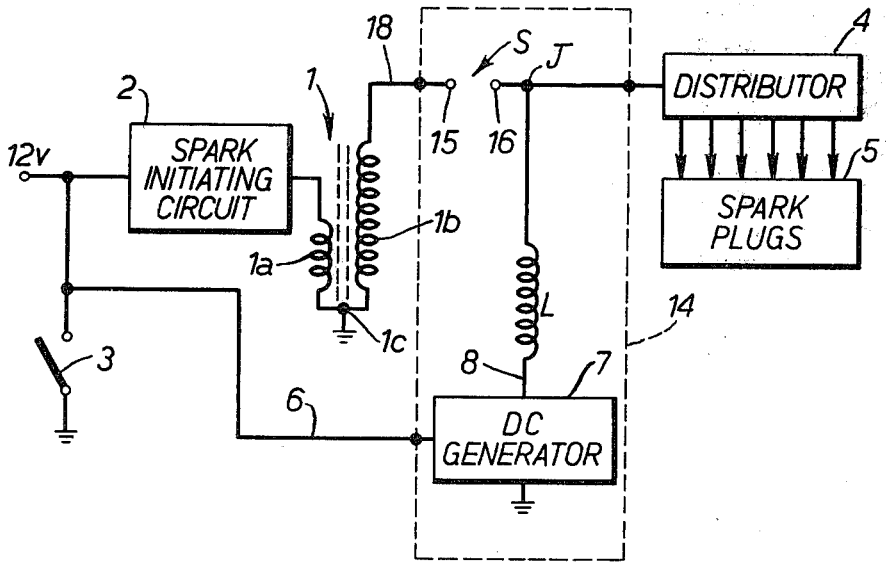
FIG. 5 illustrates another embodiment of the invention wherein an add-on unit for an existing ignition system is provided.

The present invention can also be carried into effect by means of an add-on unit for an existing ignition system. This add-on unit has the advantage that it does not require replacement of an existing conventional ignition coil. The arrangement of the add-on unit and the existing system is shown in FIG. 5.

The existing ignition system consists of items 1 to 5 which operate as previously described with reference to FIG. 1, and the add-on unit is shown within hatched outline 14. The add-on unit 14 includes the d.c. generator 7 which functions as previously described, and also includes means for isolating the voltage produced by the d.c. generator 7 from the ignition coil 1; this means consists of electrodes 15, 16 which define a spark gap S.

The voltage from the d.c. generator 7 is of insufficient magnitude to cause a spark to jump across the gap S and thus the voltage produced by the generator 7 is developed across the spark plug 5 selected by the distributor 4, rather than being fed back to the coil 1. As is shown, the conventional ignition coil 1 is in the usual manner earthed at its centre tapping 1*c* between its primary and secondary windings 1*a*, 1*b* and so without the spark gap S, the output voltage of the d.c. generator 7 would preferentially establish a current flowing to earth through the secondary of the coil 1, rather than establish a spark sustaining current through the spark plugs 5.

The spark gap S is so arranged that a high voltage output pulse from the secondary of the coil 1 can establish an arc between the electrodes 15, 16 defining the gap, and in this way the high voltage pulses produced on operation of the ignition generator 2, pass to the distributor 4 and hence to the spark plugs 5.

The unit 14 further includes an inductor L which has the function of preventing the high voltage pulses which jump the spark gap S from passing to the d.c. generator 7. The inductor L presents a relatively low impedance to the direct current from the generator 7 thereby allowing it to pass to the spark plugs 5 to sustain a spark, but the inductor presents a relatively high impedance to the rapid current changes produced by the current pulses jumping the spark gap S from the coil 1, and hence these pulses pass preferentially to the distributor 4 and the spark plugs 5 rather than flowing to d.c. generator 7. Accordingly, damage to the generator 7 is prevented.

Thus, the add-on unit 14 can be readily fitted to an existing ignition system. The connections required are that the spark gap S is connected into the h.t. lead 16 which runs from the ignition coil 1 to the distributor 4 and the generator 7 is connected to receive the engine's low voltage supply. If switching of the generator 7 is required, the output of the contact breaker 3 is also fed to the unit.

The ease of installation of the unit with an existing ignition is effected by the spark gap S and the inductor L which allow the pulses from the coil 1 and the voltage from the generator 7 to be applied effectively independently of one another to the spark plugs. However, while in the preferred embodiment a spark gap S is used, other voltage isolating means could be used instead. For example the spark gap S could be replaced by a high voltage diode or other means capable of effecting a unidirectional current flow for high voltages capable of establishing a spark across the spark plugs of an internal combustion engine.

I claim:

1. Apparatus adapted for use with an internal combustion engine including a spark ignition system having a relatively low voltage source and spark pulse generating means (2) for supplying to a spark plug (5) via a given path (18) electrical pulses of a magnitude to initiate spark ignition across a spark plug, comprising (a) d-c to d-c converter means (7) for producing from said relatively low voltage source a relatively high voltage current for sustaining the spark initiated by one of said pulses; and (b) voltage isolating means for independently connecting the spark pulse generating means and said converter means with said spark plug, respectively, said isolating means including (1) first means (S) connected in series in said given path for connecting the spark pulse generating means with the spark plug; and (2) means including a series-connected inductor (L) for connecting said converter means with said given path at a junction (J) between said first means and the spark plug, whereby said first means isolates the converter means from the pulse generating means, and the inductor isolates the converter means from the pulses from the spark pulse generator means.

2. Apparatus as defined in claim 1, and further including switch means (3) for disabling said converter means to interrupt the supply of the high voltage sustaining current to the spark plug.

3. Apparatus as defined in claim 1, wherein the engine includes a cylinder in which fuel is ignited by the spark from the spark plug, the high voltage current from said converter means being applied to the spark plug continuously during operation of the engine, the magnitude of the output voltage of said converter means being such as to cause the spark to be extinguished automatically upon a rise in cylinder gas pressure occurring upon the combustion of fuel in the cylinder.

4. Apparatus as defined in claim 1, wherein said spark ignition system further includes means connecting said low voltage source with an input terminal of the spark pulse generating means, and ignition coil means (1) connecting the spark pulse generating means with the spark plug, said ignition coil means including primary (1*a*) and secondary (1*b*) windings, and means (3) for interrupting the connection between said source and the spark pulse generating means, thereby to produce a change in the current supplied to the primary winding by the spark pulse generating means.

5. Apparatus as defined in claim 4, wherein said spark pulse generating means includes a capacitor, means for charging said capacitor to a voltage greater than said supply voltage, and means for discharging said capacitor through the primary winding, thereby to produce said current change in the primary winding.

6. Apparatus as defined in claim 1, wherein the engine includes a plurality of cylinders, a plurality of spark plugs associated with said cylinders, respectively, and distributor means (4) for supplying both the spark-initiating pulses and the spark sustaining current to the spark plugs, respectively.

7. Apparatus as defined in claim 1, wherein said first isolating means comprises a series-connected spark gap (S) across which the pulses from the spark pulse generating means jump during passage to the spark plug, the magnitude of the output voltage from said converter means being less than that required to initiate a spark across the spark plug.

8. Apparatus as defined in claim 1, wherein said converter means is operable to convert from said relatively low voltage supply a high voltage capable of delivering said spark sustaining current to the spark plug.

9. An arrangement as claimed in claim 8, wherein said converter means comprises a step up transformer having primary and secondary windings, an oscillator driven from said low voltage supply and arranged to produce an oscillatory current flow in the primary winding of the step up transformer, whereby to produce in the secondary winding thereof a stepped-up alternating voltage, means arranged to rectify said stepped voltage so as to provide said output voltage for application to the spark plug, and input means coupled to said oscillator so as to enable or disable the oscillator in dependence upon the state of an input signal applied to the input means, whereby to switch the converter means on or off in dependence upon the state of the input signal.

10. An arrangement as claimed in claim 1, wherein the output voltage of said converter means is on the order of 2000 volts.

* * * * *